US010297182B2

(12) United States Patent
Guo et al.

(10) Patent No.: US 10,297,182 B2
(45) Date of Patent: May 21, 2019

(54) PIXEL ARRAY HAVING SUB-PIXEL GROUPS AND DRIVING METHOD THEREOF AND DISPLAY PANEL

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Renwei Guo, Beijing (CN); Xue Dong, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 46 days.

(21) Appl. No.: 15/148,266

(22) Filed: May 6, 2016

(65) Prior Publication Data

US 2017/0092175 A1 Mar. 30, 2017

(30) Foreign Application Priority Data

Sep. 29, 2015 (CN) ..... 2015 1 0634192

(51) Int. Cl.
*G09G 5/10* (2006.01)
*G09G 3/20* (2006.01)

(52) U.S. Cl.
CPC ... *G09G 3/2003* (2013.01); *G09G 2300/0452* (2013.01); *G09G 2300/0465* (2013.01)

(58) Field of Classification Search
CPC ..... G09G 3/2003; G09G 2300/0465; G09G 2300/0454
See application file for complete search history.

(56) References Cited

U.S. PATENT DOCUMENTS

2002/0063701 A1* 5/2002 Sano ..... G09G 3/2003 345/204
2003/0214512 A1* 11/2003 Cheng ..... G09G 5/393 345/611
2006/0033879 A1* 2/2006 Covannon ..... G02B 27/017 351/221
2009/0079733 A1* 3/2009 Fukushima ..... H04N 13/0404 345/419

(Continued)

FOREIGN PATENT DOCUMENTS

CN 103280162 A 9/2013
CN 103777393 A 5/2014

(Continued)

OTHER PUBLICATIONS

First Chinese Office Action dated Jun. 22, 2017.

*Primary Examiner* — Jonathan M Blancha
(74) *Attorney, Agent, or Firm* — Dilworth & Barrese, LLP.; Michael J. Musella, Esq.

(57) ABSTRACT

A pixel array is provided. The pixel array includes a plurality of sub-pixel groups arranged in a two-dimensional matrix along a row direction and a column direction, each of the sub-pixel groups including a plurality of actual sub-pixels of a same color arranged closely; each of the sub-pixel groups being configured such that all of the actual sub-pixels thereof are driven independently.

10 Claims, 4 Drawing Sheets

(56) References Cited

U.S. PATENT DOCUMENTS

| | | | | |
|---|---|---|---|---|
| 2009/0079873 | A1* | 3/2009 | Otawara | G09G 3/2025 348/678 |
| 2012/0293531 | A1* | 11/2012 | Wang | G09G 3/2003 345/589 |
| 2013/0057456 | A1* | 3/2013 | Omoto | H01L 51/5225 345/76 |

FOREIGN PATENT DOCUMENTS

| | | | |
|---|---|---|---|
| CN | 104900682 | A | 9/2015 |
| EP | 0347187 | B1 | 4/1994 |

* cited by examiner

PIXEL ARRAY HAVING SUB-PIXEL GROUPS AND DRIVING METHOD THEREOF AND DISPLAY PANEL

TECHNICAL FIELD

The present disclosure relates to a pixel array and a driving method thereof and a display panel.

BACKGROUND

In current display panels, a common pixel design is that a physical pixel is formed by three sub-pixels (a red sub-pixel, a green sub-pixel and a blue sub-pixel) or four sub-pixels (a red sub-pixel, a green sub-pixel, a blue sub-pixel and a white sub-pixel) for displaying, so that a physical resolution is a visual resolution. In practical applications, sometimes the visual resolution may be low, for example, in a process of continuously viewing images; and sometimes a high visual resolution is required, for example, at the time of viewing details of a fine image. Since the visual resolution of the display panel is fixed, requirements on different visual resolutions cannot be met.

SUMMARY

One embodiment of the present disclosure provides a pixel array, comprising a plurality of sub-pixel groups arranged in a two-dimensional matrix along a row direction and a column direction, each of the sub-pixel groups including a plurality of actual sub-pixels of a same color arranged closely; each of the sub-pixel groups being configured such that all of the actual sub-pixels thereof are driven independently.

In an example, each of the sub-pixel groups includes two or three actual sub-pixels of the same color.

In an example, each of the sub-pixel groups is configured such that all of the actual sub-pixels thereof are capable of being turned on at the same time and each actual sub-pixel is capable of being turned on independently.

In an example, the sub-pixel groups of odd-numbered rows are aligned in the column direction, the sub-pixel groups of even-numbered rows are aligned in the column direction, and the sub-pixel groups of the odd-numbered rows and the sub-pixel groups in the even-numbered rows are staggered in the row direction.

In an example, a staggering distance of the sub-pixel groups of the odd-numbered row and the even-numbered row in the row direction is half of a size of one of the sub-pixel groups along the row direction.

In an example, a ratio of a length of each of the actual sub-pixels along the column direction to a length of each of the actual sub-pixels along the row direction is 2:1 to 4:1.

In an example, the plurality of sub-pixel groups include sub-pixel groups of different colors.

Another embodiment of the present disclosure provides a driving method of the above mentioned pixel array, comprising: step S100: dividing an image to be displayed into a plurality of theoretical pixel units, each theoretical pixel unit including a plurality of theoretical sub-pixels of different colors, and calculating a theoretical brightness value of each theoretical sub-pixel; step S200: determining whether or not the actual sub-pixels in each of the sub-pixel groups are turned on: upon one actual sub-pixel in each of the sub-pixel groups being turned on, the method including: step S211: calculating an actual brightness value of the actual sub-pixel turned on in the sub-pixel group according to the theoretical brightness value of the theoretical sub-pixel; step S212: inputting signals to the actual sub-pixel turned on in the sub-pixel group, so as to make actual brightness of the actual sub-pixels turned on in the respective sub-pixel groups reach the actual brightness value calculated in step S211.

In an example, upon all of the actual sub-pixels in each sub-pixel group being turned on at the same time, the method comprises: step S221: calculating an actual brightness value of each sub-pixel group according to the theoretical brightness values of the theoretical sub-pixels; step S222: inputting signals to the sub-pixel group, so as to make actual brightness of the respective sub-pixel groups reach the actual brightness value calculated in step S221.

In an example, in step S211, an actual brightness value of the actual sub-pixel turned on in each of the sub-pixel groups at least includes a sum of part of a theoretical brightness value of a first theoretical sub-pixel, and part of theoretical brightness values of one or multiple theoretical sub-pixels which are of a same color with, adjacent to and located in a same row or column with the first theoretical sub-pixel; wherein, a position of the first theoretical sub-pixel in the image to be displayed corresponds to a position of the sub-pixel group to be calculated in the pixel array.

In an example, in step S221, an actual brightness value of each of the sub-pixel groups at least includes a sum of part of a theoretical brightness value of a first theoretical sub-pixel, and part of theoretical brightness values of adjacent one or multiple sub-pixels which are of a same color with, adjacent to and located in a same row or column with the first theoretical sub-pixel; wherein, a position of the first theoretical sub-pixel in the image to be displayed corresponds to a position of the sub-pixel group to be calculated in the pixel array.

In an example, a size of each of the theoretical pixel units along a row direction is greater than a size of one sub-pixel group along the row direction and less than a size of two sub-pixel groups along the row direction, and a size of each of the theoretical pixel units along a column direction is equal to a size of one sub-pixel group along the column direction.

In an example, a size of each of the theoretical pixel units along the row direction is equal to a size of one and a half of sub-pixel groups along the row direction.

In an example, in step S211, an actual brightness value A (Hm, Sn) of an actual sub-pixel turned on in a sub-pixel group of a Hm-th row and a Sn-th column is calculated by a formula as follows: $A(Hm, Sn)=cT(Hm, Lz-3)+aT(Hm, Lz)+bT(Hm, Lz+3)$, where, T (Hm, Lz) is a theoretical brightness value of a first theoretical sub-pixel corresponding to a position of the sub-pixel group of the Hm-th row and the Sn-th column, T (Hm, Lz−3) and T (Hm, Lz+3) are theoretical brightness values of two theoretical sub-pixels which are of a same color with, adjacent to and located in a same row with the first theoretical sub-pixel, a is a first weighting coefficient, b is a second weighting coefficient, and c is a third weighting coefficient, $c+a+b=1$.

In an example, in step S211, an actual brightness value A (Hm, Sn) of an actual sub-pixel turned on in a sub-pixel group of a Hm-th row and a Sn-th column is calculated by a formula as follows: $A(Hm, Sn)=aT(Hm, Lz)+bT(Hm, Lz+3)+dT(Hm, Lz+6)$, where, T (Hm, Lz) is a theoretical brightness value of a first theoretical sub-pixel corresponding to a position of the sub-pixel group of the Hm-th row and the Sn-th column, T (Hm, Lz+3) and T (Hm, Lz+6) are theoretical brightness values of two theoretical sub-pixels which are of a same color with, adjacent to and located in a same row with the first theoretical sub-pixel, a is a first weighting coefficient, b is a second weighting coefficient, and d is a fourth weighting coefficient, a+b+d=1.

In an example, in step S211, an actual brightness value A (Hm, Sn) of an actual sub-pixel turned on in a sub-pixel group of a Hm-th row and a Sn-th column is calculated by a formula as follows: A(Hm, Sn)=aT(Hm, Lz)+eT(Hm+1, Lz), where, T (Hm, Lz) is a theoretical brightness value of a first theoretical sub-pixel corresponding to a position of the sub-pixel group of the Hm-th row and the Sn-th column, T (Hm+1, Lz) is a theoretical brightness value of a theoretical sub-pixel which is of a same color with, adjacent to and located in a same column with the first theoretical sub-pixel, a is a first weighting coefficient, and e is a fifth weighting coefficient, a+e=1.

In an example, in step S211, an actual brightness value A (Hm, Sn) of an actual sub-pixel turned on in a sub-pixel group of a Hm-th row and a Sn-th column is calculated by a formula as follows: A(Hm, Sn)=aT(Hm, Lz)+f T(Hm−1, Lz), where, m is an even number, T (Hm, Lz) is a theoretical brightness value of a first theoretical sub-pixel corresponding to a position of the sub-pixel group of the Hm-th row and the Sn-th column, T (Hm−1, Lz) is a theoretical brightness value of a theoretical sub-pixel which is of a same color with, adjacent to and located in a same column with the first theoretical sub-pixel, a is a first weighting coefficient, and f is a fifth weighting coefficient, a+f=1.

Another embodiment of the present disclosure provides a display panel, comprising the above mentioned pixel array.

In an example, the display panel further includes a driving circuit, the driving circuit being configured to independently drive a plurality of actual sub-pixels in each sub-pixel group, respectively.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the present disclosure and thus are not limitative of the disclosure.

DETAILED DESCRIPTION

In order to make objects, technical details and advantages of the embodiments of the present disclosure apparent, the technical solutions of the embodiment will be described in a clearly and fully understandable way in connection with the drawings related to the embodiments of the present disclosure. It is obvious that the described embodiments are just a part but not all of the embodiments of the present disclosure. Based on the described embodiments herein, those skilled in the art can obtain other embodiment(s), without any inventive work, which should be within the scope of the disclosure.

Figure 1:
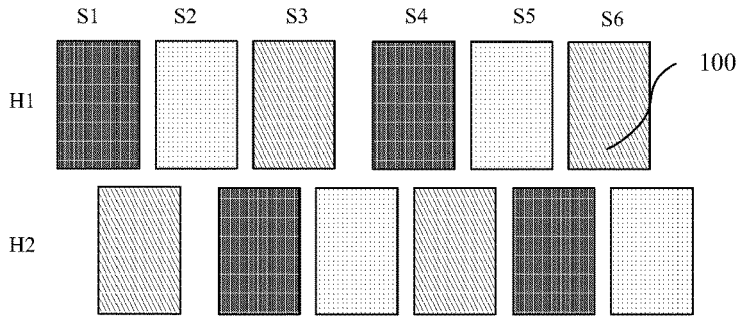
FIG. 1 is a schematic diagram of an embodiment of a pixel array of the present disclosure.
Figure 2:
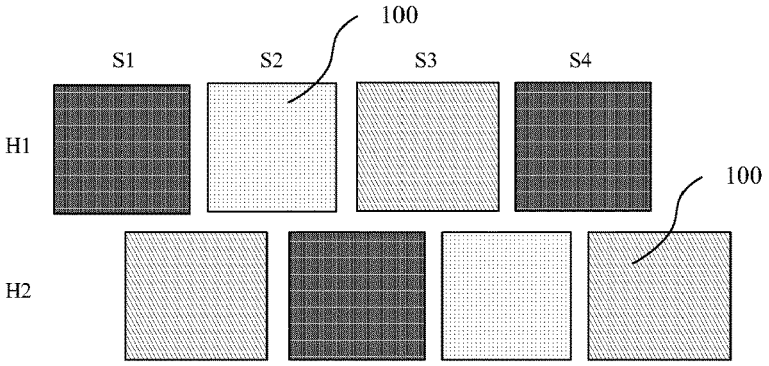
FIG. 2 is a schematic diagram of another embodiment of a pixel array of the present disclosure.

One embodiment of the present disclosure provides a pixel array. As illustrated in FIG. 1 and FIG. 2, the pixel array includes X rows and Y columns of sub-pixel periods (sub-pixel groups) 100, and each sub-pixel period 100 includes two or three actual sub-pixels of a same color arranged closely; all of the actual sub-pixels of each of the sub-pixel periods may be turned on at the same time and each actual sub-pixel of each of the sub-pixel periods may be turned on independently.

The close arrangement is arranged side by side without an interval, and X and Y are natural numbers far greater than 1.

For example, in FIG. 1, S1, S2 . . . , and S6 denote columns of the sub-pixel period, and H1 and H2 denote rows of the sub-pixel period. The diagram exemplarily illustrates six columns and two rows, which is not limited by the embodiment of the present disclosure. For each sub-pixel period (sub-pixel group) 100 in the diagram, there is included a plurality of actual sub-pixels of a same color which may be driven (controlled) independently, that is to say, the plurality of actual sub-pixels in each sub-pixel period may be turned on at the same time or not. In addition, for the whole pixel array, there is included a plurality of sub-pixel periods of different colors, and as illustrated in FIG. 1 and FIG. 2, different sub-pixel periods 100 are represented by blocks of different shadows.

Each sub-pixel period of the pixel array of the embodiment includes two or three actual sub-pixels, all of the actual sub-pixels in each of the sub-pixel periods may be turned on at the same time and each actual sub-pixel in each of the sub-pixel periods may be turned on independently, which provides a premise for realizing various visual resolutions in the pixel array. That is to say, the plurality of actual sub-pixels in each sub-pixel period may be driven independently.

In order to uniformly disperse different colors in the sub-pixel periods of different colors, as an optional manner, the sub-pixel periods of an odd-numbered row and an even-numbered row are aligned in a column direction, respectively, that is, the sub-pixel periods of the odd-numbered row are aligned in the column direction, the sub-pixel periods of the even-numbered row are aligned in the column direction, and the sub-pixel periods of the odd-numbered row and the sub-pixel periods of the even-numbered row are staggered in the row direction.

Further, a staggering distance of the sub-pixel periods (a distance by which the adjacent sub-pixel periods staggered) of the odd-numbered rows and the even-numbered row in a row direction is half of a width of one of the sub-pixel periods. In this way, the sub-pixel periods of a same color are arranged in a triangle shape, and the sub-pixel periods of different colors are distributed more uniformly.

For example, a ratio of a length of each of the actual sub-pixels along a longitudinal direction to a length of each of the actual sub-pixels along a transverse direction is 2:1, 3:1 or 4:1, that is, a ratio between a length of each of the actual sub-pixels along a column direction and a length of each of the actual sub-pixels along a row direction is 2:1, 3:1 or 4:1, for example, may be any value in a range of 2:1 to 4:1.

For example, a driving method of the pixel array described above includes the following steps.

Step S100: dividing an image to be displayed into a plurality of theoretical pixel units, each theoretical pixel unit including a plurality of theoretical sub-pixels of different colors, and calculating a theoretical brightness value of each theoretical sub-pixel;

Step S200: judging a status whether or not the actual sub-pixels in each of the sub-pixel periods are turned on:

upon one actual sub-pixel being turned on in each sub-pixel period, including:

Step S211: calculating an actual brightness value of the actual sub-pixel turned on in the sub-pixel period according to the theoretical brightness value of the theoretical sub-pixel;

Step S212: inputting signals to the actual sub-pixel turned on in the sub-pixel period, so as to make actual brightness of the actual sub-pixels turned on in the respective sub-pixel periods reach the actual brightness value calculated in step S211;

Upon all of the actual sub-pixels in each sub-pixel period being turned on at the same time, the method includes:

Step S221: calculating an actual brightness value of each sub-pixel period according to the theoretical brightness values of the theoretical sub-pixels;

Step S222: inputting signals to the sub-pixel period, so as to make actual brightness of the respective sub-pixel periods reach the actual brightness value calculated in step S221.

The theoretical brightness value of each theoretical sub-pixel calculated in step S100 is a basis of the driving method of the embodiment; hereinafter, it is described an exemplary method for calculating a theoretical brightness value of each theoretical sub-pixel.

Figure 3:
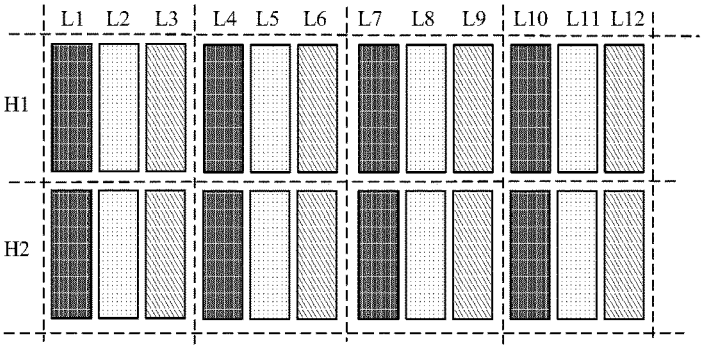
FIG. 3 is a schematic diagram of a conventional pixel array.

FIG. 3 is a schematic diagram of a conventional pixel array. For convenience of description, as illustrated in FIG. 3, an existing pixel array includes two rows and twelve columns of sub-pixels, in each row, red (R), green (G) and blue (B) sub-pixels are arranged sequentially, wherein, the two rows are represented by H1 and H2, respectively, and the twelve columns are represented by L1, L2, L3, . . . , and L12. In the pixel array illustrated in FIG. 3, the RGB sub-pixels arranged sequentially are a pixel unit, and the pixel array illustrated in FIG. 1 is divided into two rows and four columns of pixel units by dotted lines.

In step S100, the respective theoretical pixel units correspond to the pixel units (a portion of dotted box) illustrated in FIG. 3 one by one, and theoretical sub-pixels of the respective theoretical pixel units correspond to the sub-pixels (a portion of solid line box) illustrated in FIG. 3. In step S100, a theoretical brightness value of each theoretical sub-pixel is: brightness values of the respective sub-pixels when the pixel array illustrated in FIG. 3 is used for displaying. In this way, a theoretical brightness value of each theoretical sub-pixel may be calculated.

Figure 4:
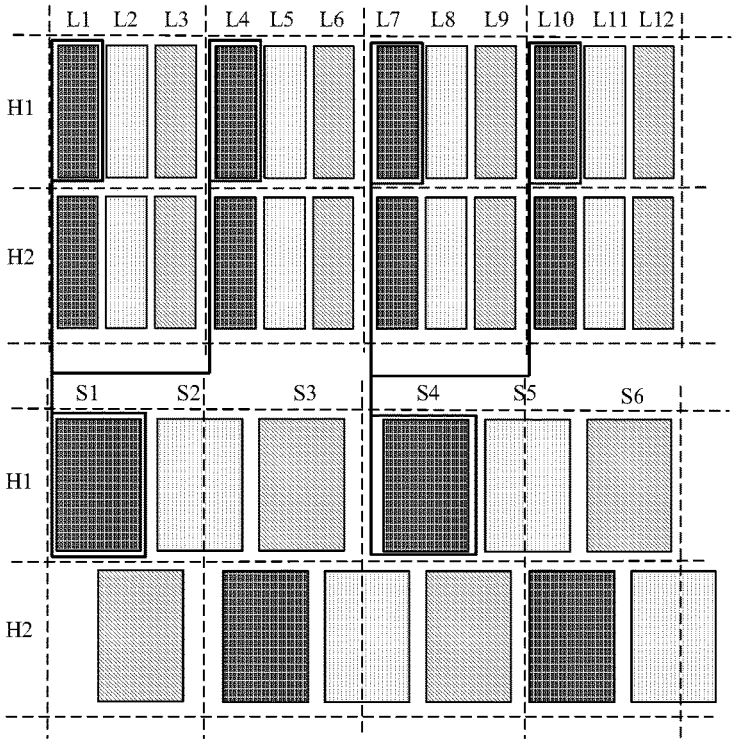
FIG. 4 is a corresponding position diagram between a sub-pixel period to be calculated and a first theoretical sub-pixel corresponding thereto in an embodiment of a driving method of the present disclosure.

For example, as illustrated in FIG. 4, a size of each of the theoretical pixel units along a row direction is greater than a size of one sub-pixel group along the row direction and less than a size of two sub-pixel groups along the row direction, and a size of each of the theoretical pixel units along the column direction is equal to a size of one sub-pixel group along the column direction.

In some examples, a size of each of the theoretical pixel units along the row direction is equal to a size of one and a half of sub-pixel group along the row direction.

Since each sub-pixel period includes two or three actual sub-pixels arranged closely, the two actual sub-pixels of each sub-pixel period may be turned on at the same time, or one of them may be turned on, so that there may be step 200 in the driving method, for judging a status whether or not the actual sub-pixels in each of the sub-pixel periods are turned on. When one actual sub-pixel in each sub-pixel period is turned on, an actual brightness value of the actual sub-pixel turned on in the sub-pixel period is calculated; when all of the actual sub-pixels in each sub-pixel period are turned on, an actual brightness value of the sub-pixel period is calculated.

Figure 7:
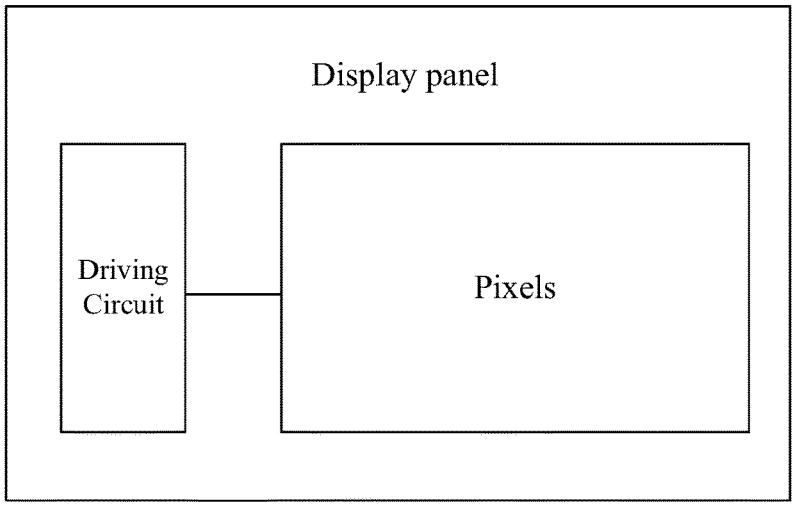
FIG. 7 is an exemplary block diagram of an embodiment of a display panel of the present disclosure.

In this way, positions of the sub-pixel period and the actual pixel sub-pixel in the pixel array are same, the driving method may drive all of the actual sub-pixels of the sub-pixel period in the pixel array to be light, with a low visual resolution, or may further drive one sub-pixel of the sub-pixel period in the pixel array to be light, with a high visual resolution. In this way, a display panel including the pixel array described above, can meet user requirements on two visual resolutions through a physical arrangement of a same pixel array. For example, as illustrated in FIG. 7, the display panel further includes a driving circuit, and the driving circuit is configured to independently drive a plurality of actual sub-pixels in each sub-pixel group, respectively.

In step S211 and step S221, when calculating an actual brightness value of the actual sub-pixel turned on in the sub-pixel period and an actual brightness value of the sub-pixel period according to the theoretical brightness value of the theoretical sub-pixel, each of the two at least includes a sum of part of a theoretical brightness value of a first theoretical sub-pixel, and part of theoretical brightness values of one or multiple theoretical sub-pixels which are of a same color with, adjacent to and located in a same row or column with the first theoretical sub-pixel; wherein, a position of the first theoretical sub-pixel in the image to be displayed corresponds to a position of the sub-pixel period to be calculated in the pixel array.

However, when calculating an actual brightness value of the actual sub-pixel turned on in the sub-pixel period in step S211, weights occupied by the theoretical brightness value of each first theoretical sub-pixel and theoretical brightness values of one or multiple theoretical sub-pixels which are of a same color with, adjacent to and located in a same row or column with the first theoretical sub-pixel, are different from the weights occupied when calculating the theoretical brightness value of each sub-pixel period in step S221.

Therefore, hereinafter, only a specific method for calculating an actual brightness value of the actual pixel turned on in the sub-pixel period in step S211 is specifically described, and a specific method for calculating an actual brightness value of the sub-pixel period in step S221 is similar thereto, which will not be repeated here.

Exemplary method I: in step S211, an actual brightness value A (Hm, Sn) of an actual sub-pixel turned on in a sub-pixel period of a Hm-th row and a Sn-th column is calculated by a formula as follows:

$$A(Hm,Sn)=cT(Hm,Lz-3)+aT(Hm,Lz)+bT(Hm,Lz+3)$$

Where, T (Hm, Lz) is a theoretical brightness value of a first theoretical sub-pixel corresponding to a position of the sub-pixel period of the Hm-th row and the Sn-th column, T (Hm, Lz−3) and T (Hm, Lz+3) are theoretical brightness values of two adjacent theoretical sub-pixels which are of a same color with, adjacent to and located in a same row with the first theoretical sub-pixel, a is a first weighting coefficient, b is a second weighting coefficient, and c is a third weighting coefficient, c+a+b=1.

For example, FIG. 4 is a corresponding position diagram between a sub-pixel period to be calculated and a first theoretical sub-pixel corresponding thereto in an embodiment of a driving method of the present disclosure, and meanwhile, illustrates a method for commonly using a first theoretical sub-pixel and one theoretical sub-pixel which is of a same color with, adjacent to and located in a same row with the first theoretical sub-pixel, by an actual sub-pixel turned on in the sub-pixel period to be calculated. As illustrated in FIG. 4, c=0, a first theoretical sub-pixel corresponding to a position of a sub-pixel period of a H1-th row and a S1-th column is a theoretical sub-pixel of a H1-th row and a L1-th column, and a theoretical sub-pixel of a H1-th row and a L4-th column is a theoretical sub-pixel which is of a same color with, adjacent to and located in a same row with the first theoretical sub-pixel; a first theoretical sub-pixel corresponding to a position of a sub-pixel period of a H1-th row and a S4-th column is a theoretical sub-pixel of a H1-th row and a L7-th column, and a theoretical sub-pixel of a H1-th row and a L10-th column is a theoretical sub-pixel which is of a same color with, adjacent to and located in a same row with the first theoretical sub-pixel.

Figure 5:
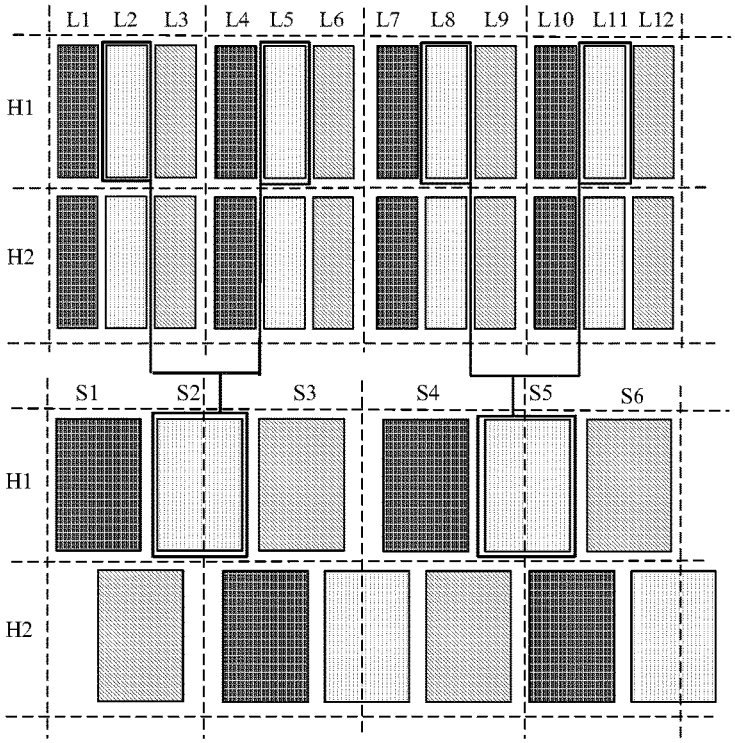
FIG. 5 is a corresponding position diagram between a sub-pixel period to be calculated and a first theoretical sub-pixel corresponding thereto in another embodiment of the driving method of the present disclosure.

For example, FIG. 5 is a corresponding position diagram between a sub-pixel period to be calculated and a first theoretical sub-pixel corresponding thereto in another embodiment of a driving method of the present disclosure, and meanwhile, illustrates a method for commonly using a first theoretical sub-pixel and one theoretical sub-pixel which is of a same color with, adjacent to and located in a same row with the first theoretical sub-pixel, by an actual sub-pixel turned on in the sub-pixel period to be calculated. As illustrated in FIG. 5, c=0; a first theoretical sub-pixel corresponding to a position of a sub-pixel period of a H1-th row and a S2-th column is a theoretical sub-pixel of a H1-th row and a L2-th column, and a theoretical sub-pixel of a H1-th row and a L5-th column is a theoretical sub-pixel which is of a same color with, adjacent to and located in a same row with the first theoretical sub-pixel; a first theoretical sub-pixel corresponding to a position of a sub-pixel period of a H1-th row and a S5-th column is a theoretical sub-pixel of a H1-th row and a L8-th column, and a theoretical sub-pixel of a H1-th row and a L11-th column is a theoretical sub-pixel which is of a same color with, adjacent to and located in a same row with the first theoretical sub-pixel.

Figure 6:
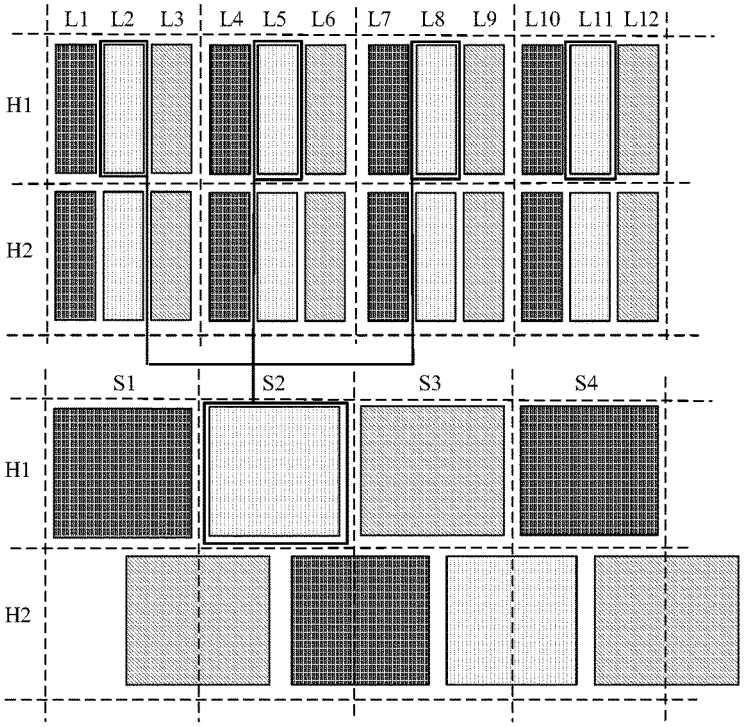
FIG. 6 is a corresponding position diagram between a sub-pixel period to be calculated and a first theoretical sub-pixel corresponding thereto in yet another embodiment of the driving method of the present disclosure.

For example, FIG. 6 is a corresponding position diagram between a sub-pixel period to be calculated and a first theoretical sub-pixel corresponding thereto in yet another embodiment of a driving method of the present disclosure, and meanwhile, shows a method for commonly using a first theoretical sub-pixel and one theoretical sub-pixel which is of a same color with, adjacent to and located in a same row with the first theoretical sub-pixel, by an actual sub-pixel turned on in the sub-pixel period to be calculated. As illustrated in FIG. 6, a first theoretical sub-pixel corresponding to a position of a sub-pixel period of a H1-th row and a S2-th column is a theoretical sub-pixel of a H1-th row and a L5-th column, and a theoretical sub-pixels of a H1-th row and a L2-th column and a theoretical sub-pixels of a H1-th row and a L8-th column are two theoretical sub-pixels which are of a same color with, adjacent to and located in a same row with the first theoretical sub-pixel.

It should be noted that, as illustrated in FIG. 4 to FIG. 6, according to the corresponding positions, finding a first theoretical sub-pixel corresponding to a position of the sub-pixel period to be calculated and one or two theoretical sub-pixels which are of a same color with, adjacent to and located in a same row with the first theoretical sub-pixel, is only used for illustration.

Exemplary method II: in step S211, an actual brightness value A (Hm, Sn) of an actual sub-pixel turned on in a sub-pixel period of a Hm-th row and a Sn-th column is calculated by a formula as follows:

$$A(Hm,Sn)=aT(Hm,Lz)+bT(Hm,Lz+3)+dT(Hm,Lz+6)$$

Where, T (Hm, Lz) is a theoretical brightness value of a first theoretical sub-pixel corresponding to a position of the sub-pixel group of the Hm-th row and the Sn-th column, T (Hm, Lz+3) and T (Hm, Lz+6) are theoretical brightness values of two theoretical sub-pixels which are of a same color with, adjacent to and located in a same row with the first theoretical sub-pixel, a is a first weighting coefficient, b is a second weighting coefficient, and d is a fourth weighting coefficient, a+b+d=1.

Exemplary method III: in step S211, an actual brightness value A (Hm, Sn) of an actual sub-pixel turned on in a sub-pixel period of a Hm-th row and a Sn-th column is calculated by a formula as follows:

$$A(Hm,Sn)=aT(Hm,Lz)+eT(Hm+1,Lz)$$

Where, T (Hm, Lz) is a theoretical brightness value of a first theoretical sub-pixel corresponding to a position of the sub-pixel group of the Hm-th row and the Sn-th column, T (Hm+1, Lz) is a theoretical brightness value of a theoretical sub-pixel which is of a same color with, adjacent to and located in a same column with the first theoretical sub-pixel, a is a first weighting coefficient, and e is a fifth weighting coefficient, a+e=1.

Exemplary method IV: in step S211, an actual brightness value A (Hm, Sn) of an actual sub-pixel turned on in a sub-pixel period of a Hm-th row and a Sn-th column is calculated by a formula as follows:

$$A(Hm,Sn)=aT(Hm,Lz)+fT(Hm-1,Lz)$$

Where, m is an even number, T (Hm, Lz) is a theoretical brightness value of a first theoretical sub-pixel corresponding to a position of the sub-pixel group of the Hm-th row and the Sn-th column, T (Hm−1, Lz) is a theoretical brightness value of an adjacent theoretical sub-pixel which is of a same color with, adjacent to and located in a same column with the first theoretical sub-pixel, a is a first weighting coefficient, and f is a fifth weighting coefficient, a+f=1.

It should be noted that, the formulas for calculating an actual brightness value of an actual sub-pixel turned on in a sub-pixel period of a Hm-th row and a Sn-th column illustrated above, are only used for illustration, but other formulas may be also used.

The foregoing embodiments merely are exemplary embodiments of the disclosure, and not intended to define the scope of the disclosure, and the scope of the disclosure is determined by the appended claims.

The application claims priority of Chinese Patent Application No. 201510634192.6 filed on Sep. 29, 2015, the disclosure of which is incorporated herein by reference in its entirety as part of the present application.

The invention claimed is:

1. A driving method of a pixel array comprising a plurality of sub-pixel groups arranged in a two-dimensional matrix along a row direction and a column direction, each of the sub-pixel groups including a plurality of actual sub-pixels of a same color arranged closely and each of the sub-pixel groups being configured such that all of the actual sub-pixels thereof are driven independently, wherein the driving method comprises:

step S100: dividing an image to be displayed into a plurality of theoretical pixel units, each theoretical pixel unit including a plurality of theoretical sub-pixels of different colors, and calculating a theoretical brightness value of each theoretical sub-pixel;

step S200: determining whether or not the actual sub-pixels in each of the sub-pixel groups are turned on:

upon one actual sub-pixel in each of the sub-pixel groups being turned on, the method further comprising:

step S211: calculating an actual brightness value of the actual sub-pixel turned on in the sub-pixel group according to the theoretical brightness value of the theoretical sub-pixel; and step S212: inputting signals to the actual sub-pixel turned on in the sub-pixel group, so as to make actual brightness of the actual sub-pixels turned on in the respective sub-pixel groups reach the actual brightness value calculated in step S211.

2. The driving method of the pixel array according to claim 1, wherein, upon all of the actual sub-pixels in each sub-pixel group being turned on at the same time, the method comprises:

step S221: calculating an actual brightness value of each sub-pixel group according to the theoretical brightness values of the theoretical sub-pixels;

step S222: inputting signals to the sub-pixel group, so as to make actual brightness of the respective sub-pixel groups reach the actual brightness value calculated in step S221.

3. The driving method of the pixel array according to claim 2, wherein, in step S221, an actual brightness value of each of the sub-pixel groups at least includes a sum of part of a theoretical brightness value of a first theoretical sub-pixel, and part of theoretical brightness values of adjacent one or multiple sub-pixels which are of a same color with, adjacent to and located in a same row or column with the first theoretical sub-pixel; wherein, a position of the first theoretical sub-pixel in the image to be displayed corresponds to a position of the sub-pixel group to be calculated in the pixel array.

4. The driving method of the pixel array according to claim 1, wherein, in step S211, an actual brightness value of the actual sub-pixel turned on in each of the sub-pixel groups at least includes a sum of part of a theoretical brightness value of a first theoretical sub-pixel, and part of theoretical brightness values of one or multiple theoretical sub-pixels which are of a same color with, adjacent to and located in a same row or column with the first theoretical sub-pixel; wherein, a position of the first theoretical sub-pixel in the image to be displayed corresponds to a position of the sub-pixel group to be calculated in the pixel array.

5. The driving method of the pixel array according to claim 1, wherein, a size of each of the theoretical pixel units along a row direction is greater than a size of one sub-pixel group along the row direction and less than a size of two sub-pixel groups along the row direction, and a size of each of the theoretical pixel units along a column direction is equal to a size of one sub-pixel group along the column direction.

6. The driving method of the pixel array according to claim 5, wherein, a size of each of the theoretical pixel units along the row direction is equal to a size of one and a half of sub-pixel groups along the row direction.

7. The driving method of the pixel array according to claim 1, wherein, in step S211, an actual brightness value A (Hm, Sn) of an actual sub-pixel turned on in a sub-pixel group of a Hm-th row and a Sn-th column is calculated by a formula as follows:

$$A(Hm,Sn)=cT(Hm,Lz-3)+aT(Hm,Lz)+bT(Hm,Lz+3)$$

where, T (Hm, Lz) is a theoretical brightness value of a first theoretical sub-pixel corresponding to a position of the sub-pixel group of the Hm-th row and the Sn-th column, T (Hm, Lz−3) and T (Hm, Lz+3) are theoretical brightness values of two theoretical sub-pixels which are of a same color with, adjacent to and located in a same row with the first theoretical sub-pixel, a is a first weighting coefficient, b is a second weighting coefficient, and c is a third weighting coefficient, c+a+b=1.

8. The driving method of the pixel array according to claim 1, wherein, in step S211, an actual brightness value A (Hm, Sn) of an actual sub-pixel turned on in a sub-pixel group of a Hm-th row and a Sn-th column is calculated by a formula as follows:

$$A(Hm,Sn)=aT(Hm,Lz)+bT(Hm,Lz+3)+dT(Hm,Lz+6)$$

where, T (Hm, Lz) is a theoretical brightness value of a first theoretical sub-pixel corresponding to a position of the sub-pixel group of the Hm-th row and the Sn-th column, T (Hm, Lz+3) and T (Hm, Lz+6) are theoretical brightness values of two theoretical sub-pixels which are of a same color with, adjacent to and located in a same row with the first theoretical sub-pixel, a is a first weighting coefficient, b is a second weighting coefficient, and d is a fourth weighting coefficient, a+b+d=1.

9. The driving method of the pixel array according to claim 1, wherein, in step S211, an actual brightness value A (Hm, Sn) of an actual sub-pixel turned on in a sub-pixel group of a Hm-th row and a Sn-th column is calculated by a formula as follows:

$$A(Hm,Sn)=aT(Hm,Lz)+eT(Hm+1,Lz)$$

where, T (Hm, Lz) is a theoretical brightness value of a first theoretical sub-pixel corresponding to a position of the sub-pixel group of the Hm-th row and the Sn-th column, T (Hm+1, Lz) is a theoretical brightness value of a theoretical sub-pixel which is of a same color with, adjacent to and located in a same column with the first theoretical sub-pixel, a is a first weighting coefficient, and e is a fifth weighting coefficient, a+e=1.

10. The driving method of the pixel array according to claim 1, wherein, in step S211, an actual brightness value A (Hm, Sn) of an actual sub-pixel turned on in a sub-pixel group of a Hm-th row and a Sn-th column is calculated by a formula as follows:

$$A(Hm,Sn)=aT(Hm,Lz)+fT(Hm-1,Lz)$$

where, m is an even number, T (Hm, Lz) is a theoretical brightness value of a first theoretical sub-pixel corresponding to a position of the sub-pixel group of the Hm-th row and the Sn-th column, T (Hm−1, Lz) is a theoretical brightness value of a theoretical sub-pixel which is of a same color with, adjacent to and located in a same column with the first theoretical sub-pixel, a is a first weighting coefficient, and f is a fifth weighting coefficient, a+f=1.

* * * * *